US005904594A

United States Patent [19]

Longueville et al.

[11] Patent Number: 5,904,594

[45] Date of Patent: May 18, 1999

[54] ELECTRICAL CONNECTOR WITH SHIELDING

[75] Inventors: Jacques Longueville, Oostkamp, Belgium; Gerhard Meyer, Erlangen, Germany

[73] Assignee: Siemens Aktiengesellschaft, Munich, Germany

[21] Appl. No.: 08/849,967

[22] PCT Filed: Dec. 20, 1995

[86] PCT No.: PCT/EP95/05046

§ 371 Date: Oct. 21, 1997

§ 102(e) Date: Oct. 21, 1997

[87] PCT Pub. No.: WO96/19850

PCT Pub. Date: Jun. 27, 1996

[30] Foreign Application Priority Data

Dec. 22, 1994 [DE] Germany ..... 44 46 098

[51] Int. Cl.[6] ..... H01R 19/00

[52] U.S. Cl. ..... 439/608

[58] Field of Search ..... 439/608, 108, 439/101, 607, 571

[56] References Cited

U.S. PATENT DOCUMENTS 4,898,546 2/1990 Elco et al. .

4,914,062 4/1990 Voltz .

5,403,206 4/1995 McNamara et al. .

FOREIGN PATENT DOCUMENTS 0 365 179 A1 4/1990 European Pat. Off. .

0 422 785 4/1991 European Pat. Off. .

0 561 202 A1 9/1993 European Pat. Off. .

0 627 788 A1 7/1994 European Pat. Off. .

44 10 047 A1 6/1994 Germany .

*Primary Examiner*—Steven L. Stephan

*Assistant Examiner*—Eugene G. Byrd

*Attorney, Agent, or Firm*—Hill & Simpson

[57] ABSTRACT

The printed circuit board connector element has a plurality of signal contacts (2) arranged grid-like in a spring clip (1) and a shielding unit (3) that contains a first and second ground lamina (4, 5) that are conductively connected via a bridge (6) that have a first impressible ground terminal (7) projecting from it. The ground laminae (4, 5) respectively extend over all intervening signal contacts (2) of a column, whereby a shielding unit is provided for only every second signal contact column. As a result thereof, only one signal contact per two columns need be occupied with ground or, respectively, only one shielding unit per two columns is required for the complete shielding of all columns.

8 Claims, 3 Drawing Sheets

ELECTRICAL CONNECTOR WITH SHIELDING

SPECIFICATION

BACKGROUND OF THE INVENTION

The invention is directed to a printed circuit board connector element with a plurality of signal contacts arranged grid-like in columns and rows in a spring clip of insulator, and with a shielding unit that contains a first and second ground lamina that are conductive, are arranged at opposite sides of at least one of the signal contacts and that are conductively connected to one another via a bridge, whereby the shielding unit comprises a first ground terminal projecting from it that can be conductively connected to the printed circuit board.

Such a printed circuit board connector element is disclosed by German reference DE 44 10 047 A1.

Low-frequency printed circuit board plug connectors are being increasingly operated with faster digital signals. The extremely steep leading signal edges correspond to high frequencies. Problems with the signal transmission quality thereby arise; in particular, undesired cross-talk effects arise between neighboring signal contacts. On the other hand, it is foreseeable that both assemblies with very fast signals as well as assemblies with signals that are less fast will be employed in future devices. This gives rise to the need to connect and operate both frequency-optimized spring clips as well as standard spring clips by plugging to standard blade connector on the device backplane.

The problem of cross-talk can be conventionally solved in that the signals are conducted over only every second contact, whereas the intervening contacts are occupied with ground. In this solution, however, the plurality of terminals usable for the signal transmission is drastically reduced, so that it seems poorly suited for applications with a high signal density.

German reference DE 40 40 551 C2 discloses that a cross-talk between terminals neighboring one another in neighboring, vertical rows be prevented by inserting a shielding element between the vertical terminal rows of a spring clip. What is disadvantageous about this solution, however, that only three of the five available contact rows are usable for signals and two rows are occupied with ground.

A shielding unit with two bulkhead sheets connected by a bridge is in fact known from the initially cited Published Application. However, only connector elements—see FIGS. 2, 7 and 8—wherein a first, front half of the signal contacts of a column is directly shielded by the shielding unit belonging to this column are proposed therein. The other half of the column is shielded by two further shielding elements that are arranged at the columns adjacent at the left and right and respectively extend thereat only along the second, back half of the signal contacts. This known design solution has the disadvantage that respectively one signal contact in every column must be occupied with ground since a shielding unit is provided for each column, which is already involved in terms of fabrication technology. What is also disadvantageous in view of manufacture is the fact that two different shielding elements are employed as well as the complicated assembly sequence that derives overall. As viewed in terms of the functioning of the shielding, the known solution is problematical insofar as each shielding unit therein is connectable to the printed circuit board with only one terminal to ground, as a result whereof the reflux current cannot follow the ideal path.

SUMMARY OF THE INVENTION

The present invention is based on the object of creating an improved plug connector of the species initially cited that, particularly, reliably prevents cross-talk, that causes structural changes only at one connector element, the spring clip, and that is simple to manufacture.

In a connector element of the species initially cited, this object is inventively achieved in that c) the ground laminae respectively extend over all intervening signal contacts of a column;

d) and a shielding element is provided only for every second signal contact column.

In general terms the present invention is a printed circuit board connector element having a plurality of signal contacts arranged grid-like in columns and rows in a spring clip of an insulator. A shielding unit contains a first and second ground lamina that are conductive, are arranged at opposite sides of at least one of the signal contacts and that are conductively connected to one another via a bridge. The shielding unit has a first ground terminal projecting from it that can be conductively connected to the printed circuit board. The ground laminae respectively extend over all intervening signal contacts of a column. A shielding unit is provided only for every second signal contact column.

The shielding unit contains a spring contact that assumes the location of a signal contact of the respective column. The spring contact is held by insulation displacement contacts respectively fashioned opposite at the ends of the ground laminae at the blade connector side.

The spring contact is fashioned with lateral shoulder lying in longitudinal direction of the spring clip. The shoulders are held by the insulation displacement contacts.

A broad lug lying in longitudinal direction of the spring clip is fashioned at that end of a contact leg of the spring contact lying at the blade connector side. The lug is respectively held at the sides by an insulation displacement contact.

The middle signal contact of the respective column is replaced by the spring contact and by the ground terminal.

At least a second impressible ground contact is fashioned at the shielding unit.

The bridge is arranged at that end lying opposite the end of the shielding unit at the blade connector side. The press-in terminals of the respective signal contact column extend column-like between the first ground terminal lying behind these press-in terminals and the further ground terminals lying in front of these press-in terminals.

The press-in terminals and the impressible ground terminals extend into a printed circuit board. The terminal bores for the ground terminals respectively lie on the printed circuit board in a row in front of and behind the terminal bores for the press-in terminals of the signal contacts.

A blade connector can be provided for a further printed circuit board connectable thereto by plugging.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
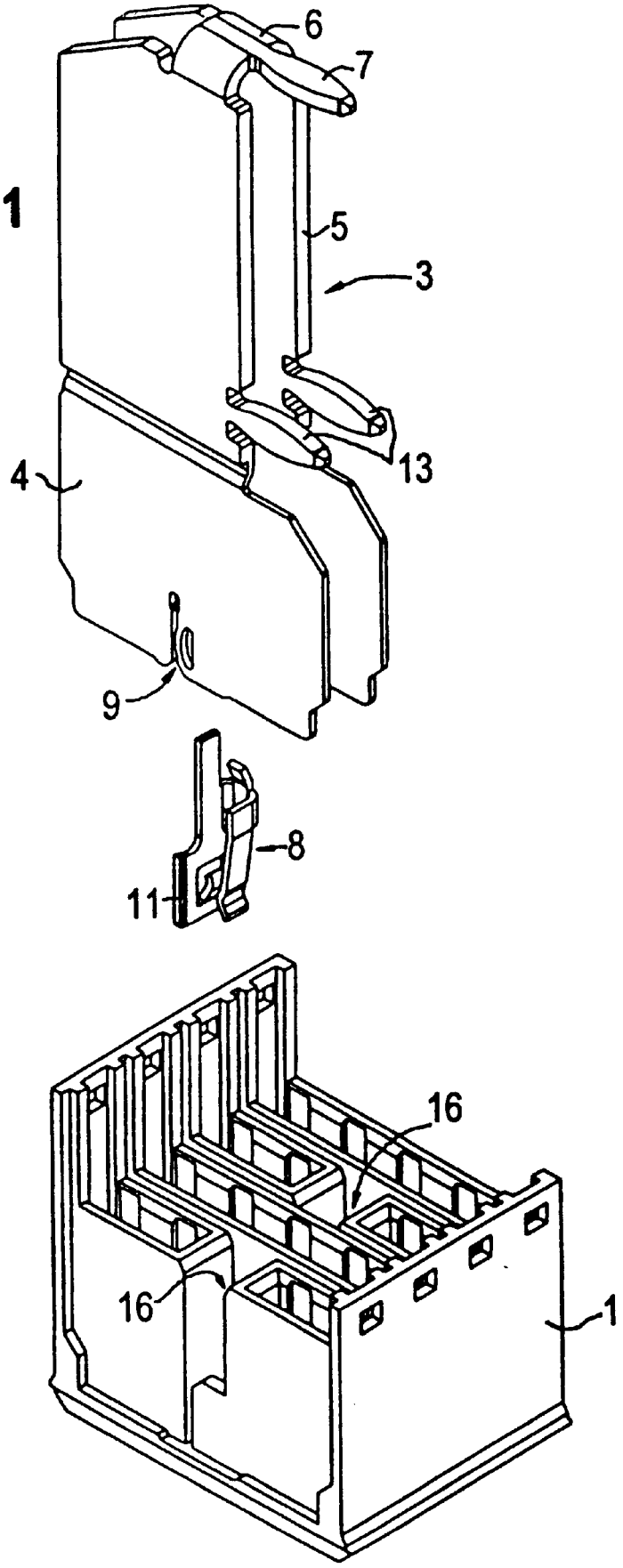
FIG. 1 a perspective view of a shielding unit with a ground spring contact that has not yet been inserted and of a spring clip.

FIG. 1, top, shows an inventive shielding unit 3 that comprises to parallel grounding laminae 4 and 5 that are conductively connected to one another at the end of the shielding unit at the blade connector side—i.e. at the very top in FIG. 1—via a bridge 6 that comprises a press-in, first ground terminal 7 projecting from it. An insulation displacement contact 9 fashioned at the ground lamina 4 is indicated at the end of the shielding unit 3 at the blade connector side. Due to the perspective that has been selected, the identically fashioned insulation displacement contact 10 lying opposite at the ground lamina 5 cannot be seen.

The present invention fundamentally combats cross-talk with ground laminae that are attached between the signal contacts of a column in the spring clip. These ground laminae must make a low-impedance contact with one or more pin contacts on the device backplane. This contact must occur as far as possible to the front in the spring clip so that the induced currents can be neutralized on the shortest paths. The shielding plates fashioned as ground laminae reduce inductive and capacitative cross-talk and act as low-induction connecting paths to ground in order to minimize the signal path impedance. They improve the transmission quality of the signal.

For producing a contact to ground from the blade connector via the spring clip or, respectively, shielding unit up to the printed circuit board connected to the spring clip, a spring contact that assumes the location of a signal contact 2 of the respective column is inventively provided in the shielding unit 3. This spring contact can be advantageously held by insulation displacement contacts 9 and 10 lying opposite that are respectively fashioned at the ends of the ground laminae 4, 5 at the side of the blade connector, as shown with reference to various embodiments in FIGS. 1 and 2.

In the embodiment of FIG. 1, the spring contact 8 is fashioned with lateral shoulders 11 lying in longitudinal direction of the spring clip 1, these thus enabling a retention by the insulation displacements contacts 9 and 10 in a simple way and, thus, a reliable electrical connection. The embodiment of FIG. 2 differs therefrom in that a broad lug 12 lying in longitudinal direction of the spring clip is fashioned therein at that end of a contact leg of the spring contact 8 lying at the blade connector side, said lug 12 being respectively held in turn at the sides by an insulation displacement contact 9 and 10. The assembly given the embodiment of FIG. 1 ensues such that the spring contact 8 is first introduced in the insulator body of the spring clip 1 and such that the signal contacts 2 fashioned as signal spring contacts at the side of the blade connector are subsequently introduced. Respectively two ground laminae are then bent interconnected as a bow and simultaneously inserted between the signal spring contacts, whereby the contacting to ground ensues at the insulation displacement contacts 9 and 10. When assembling the shielding unit according to FIG. 2, the signal spring contacts are first fitted in the insulator body of the spring clip; the ground laminae are subsequently inserted therebetween and contacted to the lug 12 of the spring contact 8 with the insulation displacement contacts 9 and 10.

Figure 2:
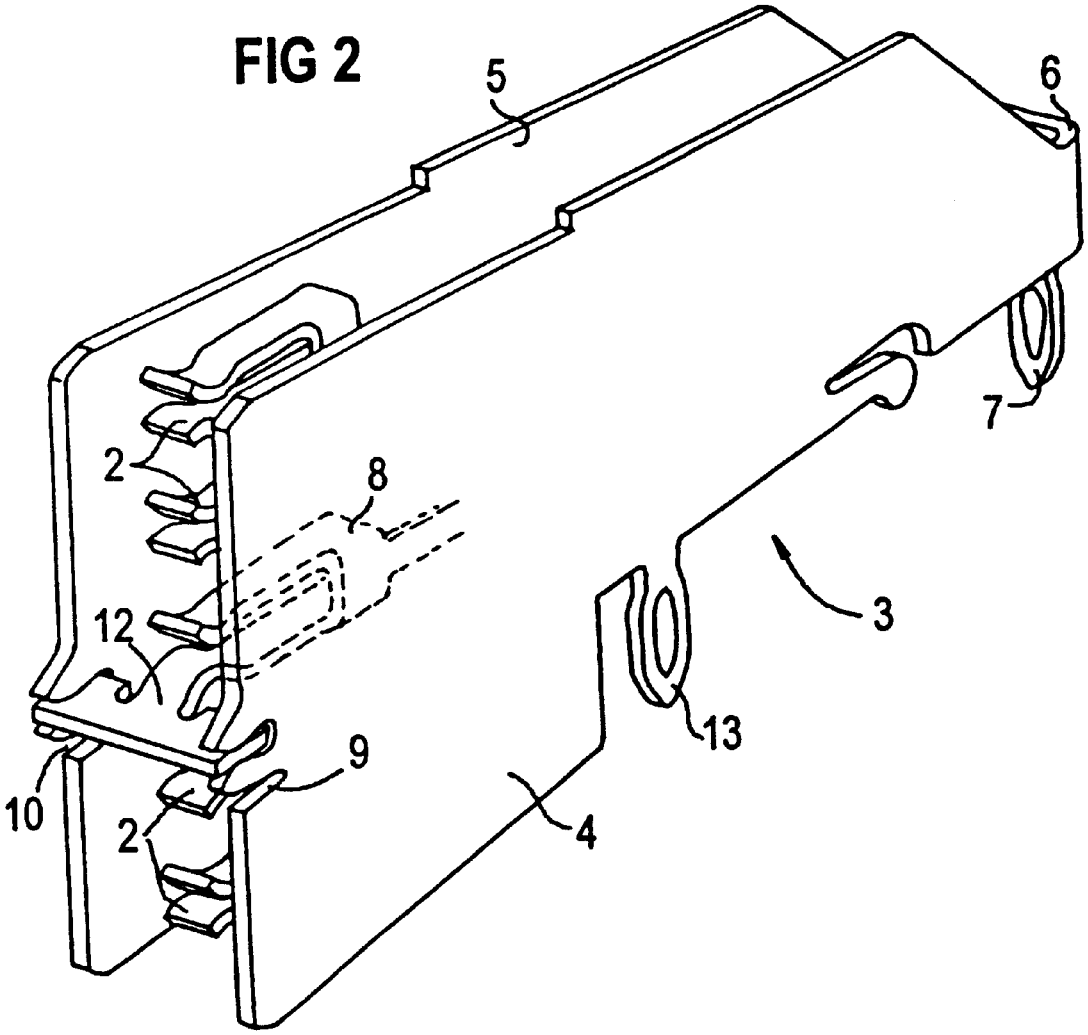
FIG. 2 a further embodiment of a shielding unit in an illustration similar to FIG. 1.
Figure 3:
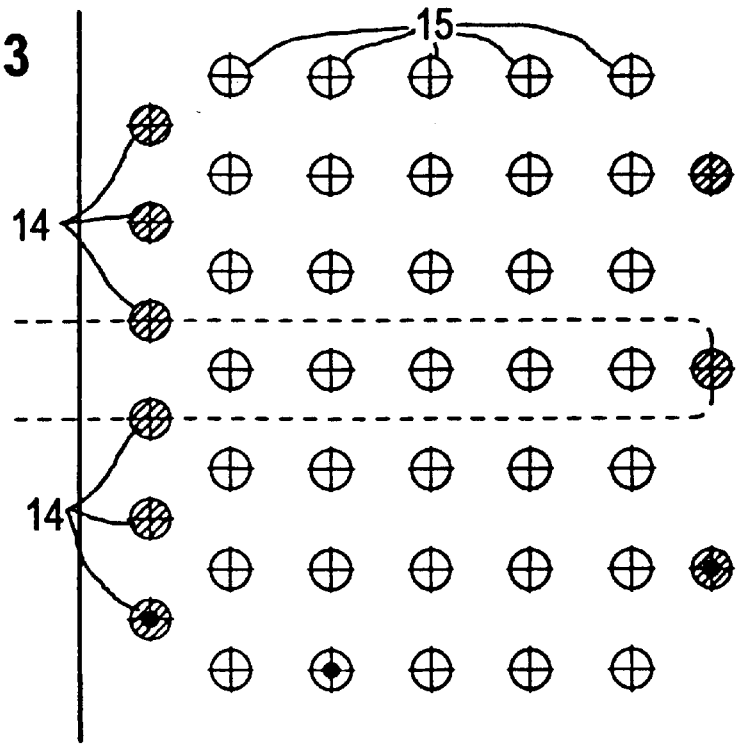
FIG. 3 a schematic plan view onto a part of a printed circuit board connected to the connector element.
Figure 4:
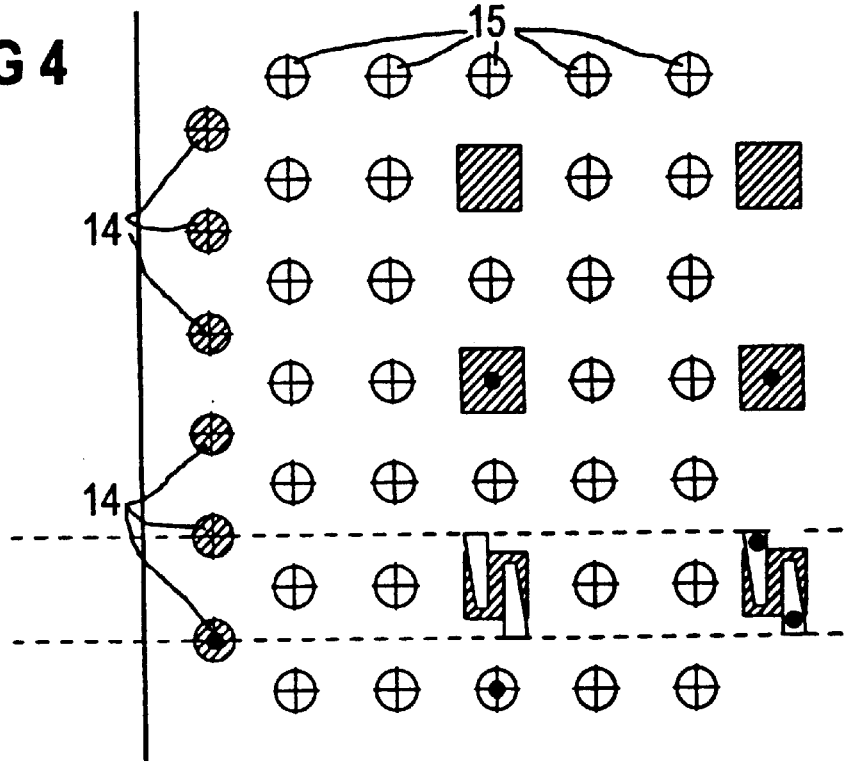
FIG. 4 another embodiment of the printed circuit board according to FIG. 3.

It is advantageous for practical applications when, as in the embodiments according to FIGS. 1 and 2, the middle signal contact 2 of the respective column is replaced by the spring contact 8 and by the ground terminal 7. As can be derived from FIG. 1, the shielding unit 3 with the spring contact 8 provided for the ground connection to the blade connector is introduced into every second column of the spring clip 1. A respective opening 16 is thereby provided in the appertaining columns of the spring clip 1 for the spring contacts 8. Inventively, the complete column-by-column shielding of the signal contacts accordingly succeeds with uniformly fashioned shielding units 3, whereby it is especially advantageous that only one shielding unit is required per two columns. This yields the further advantage that only one signal contact per two columns need be occupied with ground. It is electrically more beneficial when, as shown in FIGS. 1 and 2, when at least a second press-in ground terminal 12 is fashioned at the shielding unit 3. The configuration in FIGS. 1 and 2 has proven optimum in several respects, whereby the bridge 6 is arranged at that end lying opposite the end of the shielding unit 3 at the side of the blade connector, and whereby the press-in terminals of the respective signal contact column extend column-like between the first ground terminal 7 lying behind these press-in terminals and the further ground terminals 13 lying in front of these press-in terminals. This proceeds more exactly from the configurations of the terminal bores on the printed circuit board shown in FIGS. 3 and 4. The terminals are placed or, respectively, shaped such overall that an optimum guidance of the reflux current is possible. So that the destranding with respect to the interconnects on or, respectively, through the printed circuit board is not made more difficult, it is advantageous when the terminal bores for the ground terminals lie, as shown, in a line 14 at the front edge of the assembly and/or behind the signal terminal rows 15. The position of a respective shielding unit 3 is also indicated in FIGS. 3 and 4. FIG. 4 also shows an alternative contacting wherein push contacts having a great plastic deformability and an adequately great elastic restoring effect lie between the signal terminal rows 15.

Accordingly, the inventive connector element is especially suited for combination with a printed circuit board, whereby the press-in terminals and the impressible ground terminals 7 and 13 extend into the printed circuit board. Arrangements are thereby enabled that are composed of an inventive connector element or, respectively, of an inventive combination with a spring clip printed circuit board and of a combination of a blade connector with a further printed circuit board that can be connected thereto by plugging. The invention can be especially successfully employed in combination with the SIPAC (registered trademark) high-speed plug connector family of Siemens AG.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. Printed circuit board connector element, comprising:

a plurality of signal contacts arranged in a grid having columns and rows in a spring clip of insulating material, the number of rows being an odd number;

a shielding unit having first and second ground lamina that are conductive, are arranged at opposite sides of at least one of the signal contacts and that are conductively connected to one another via a bridge, the shielding unit having a first ground terminal projecting therefrom that can be conductively connected to the printed circuit board;

the ground laminae respectively extending over all intervening signal contacts of a column;

the shielding unit being provided only for every second signal contact column;

for each shielding unit, an opening with an H-shaped cross-section which extends through the spring clip, the opening having thin lateral wings extending over the entire column width of the spring clip; and the shielding unit having a spring contact that assumes a position of the central signal contact of the respective column.

2. The connector element according to claim 1, wherein the spring contact is held by insulation displacement contacts respectively fashioned opposite at ends of the ground laminae at a blade connector side.

3. The connector element according to claim 2, wherein the spring contact has a lateral shoulder lying in longitudinal direction of the spring clip, said shoulders being held by the insulation displacement contacts.

4. The connector element according to claim 2, wherein a broad lug lying in longitudinal direction of the spring clip is fashioned at an end of a contact leg of the spring contact lying at the blade connector side, said lug being respectively held at sides thereof by an insulation displacement contact.

5. The connector element according to claim 2, wherein a middle signal contact of the respective column is replaced by the spring contact and by a ground terminal.

6. The connector element according to claim 1, wherein at least a second impressible ground contact is structured at the shielding unit.

7. The connector element according to claim 6, wherein a bridge is arranged at an end lying opposite an end of the shielding unit at the blade connector side; and wherein press-in terminals of the respective signal contact column extend column-like between a first ground terminal lying behind these press-in terminals and a further ground terminals lying in front of these press-in terminals.

8. The connector element according to claim 7, wherein the press-in terminals and the impressible ground terminals extend into a printed circuit board and wherein terminal bores for the ground terminals respectively lie on the printed circuit board in a row in front of and behind the terminal bores for the press-in terminals of the signal contacts.

* * * * *